US007927170B2

(12) United States Patent
Bickerton et al.

(10) Patent No.: US 7,927,170 B2
(45) Date of Patent: Apr. 19, 2011

(54) PORTABLE DEVICE

(75) Inventors: Matthew James Bickerton, Surrey (GB); Michael Lee Simpson, Tokyo (JP)

(73) Assignee: JKID Limited, Surrey (GB)

( * ) Notice: Subject to any disclaimer, the term of this patent is extended or adjusted under 35 U.S.C. 154(b) by 307 days.

(21) Appl. No.: 11/917,447

(22) PCT Filed: Jun. 16, 2006

(86) PCT No.: PCT/GB2006/002216

§ 371 (c)(1),
(2), (4) Date: Dec. 13, 2007

(87) PCT Pub. No.: WO2006/136792

PCT Pub. Date: Dec. 28, 2006

(65) Prior Publication Data

US 2009/0311941 A1 Dec. 17, 2009

(30) Foreign Application Priority Data

Jun. 18, 2005 (GB) ..... 0512503.4

(51) Int. Cl.
*A63H 11/02* (2006.01)

(52) U.S. Cl. ..... 446/3; 446/62; 446/175; 446/236; 446/237; 446/238; 446/351; 446/431; 446/437; 446/443; 446/454; 446/456; 446/457; 446/458; 446/462

(58) Field of Classification Search ..... 446/3, 62, 446/175, 236–238, 351, 437, 431, 443, 454, 446/456–458, 462
See application file for complete search history.

(56) References Cited

U.S. PATENT DOCUMENTS

| | | | | | |
|---|---|---|---|---|---|
| 2,138,280 | A | * | 11/1938 | Kyser | 446/385 |
| 2,618,888 | A | * | 11/1952 | Hoff | 446/3 |
| 2,811,809 | A | * | 11/1957 | Di Franco | 446/3 |
| 3,196,580 | A | * | 7/1965 | Rakestraw | 446/484 |
| 3,530,617 | A | * | 9/1970 | Halvorson | 446/484 |
| 3,584,515 | A | * | 6/1971 | Matyas | 74/84 S |
| 4,085,539 | A | * | 4/1978 | Hanson | 446/3 |
| 4,195,703 | A | * | 4/1980 | Hawkins | 180/7.1 |
| 4,219,957 | A | * | 9/1980 | Kakuta | 446/230 |
| 4,291,490 | A | * | 9/1981 | Ikeda | 446/90 |

(Continued)

FOREIGN PATENT DOCUMENTS

FR 1564711 A 4/1969

(Continued)

*Primary Examiner* — Alvin A Hunter
*Assistant Examiner* — Alexander R. Niconovich
(74) *Attorney, Agent, or Firm* — Burns & Levinson LLP; Bruce D. Jobse, Esq.

(57) ABSTRACT

A portable device comprises a motor for providing vibration, a power source for powering the motor, a switching device for controlling the direction of the motor, propelling means for engaging a surface and for propelling the device when the motor is vibrating, the propelling means extending downwardly at an angle to the vertical, and an input device connected to the switching device, the switching device arranged to switch the direction of the motor when the input device receives a predetermined signal. Advantageously, the propelling means comprise a set of bristles. By using angled bristles, this increases friction in the backwards direction and so causes the device to move forwards when vibrating. The bristles dig into surface when vibration tries to move the object backwards, and the bristles slide over surface when vibration tries to move object forwards.

9 Claims, 10 Drawing Sheets

U.S. PATENT DOCUMENTS

Figure 1:
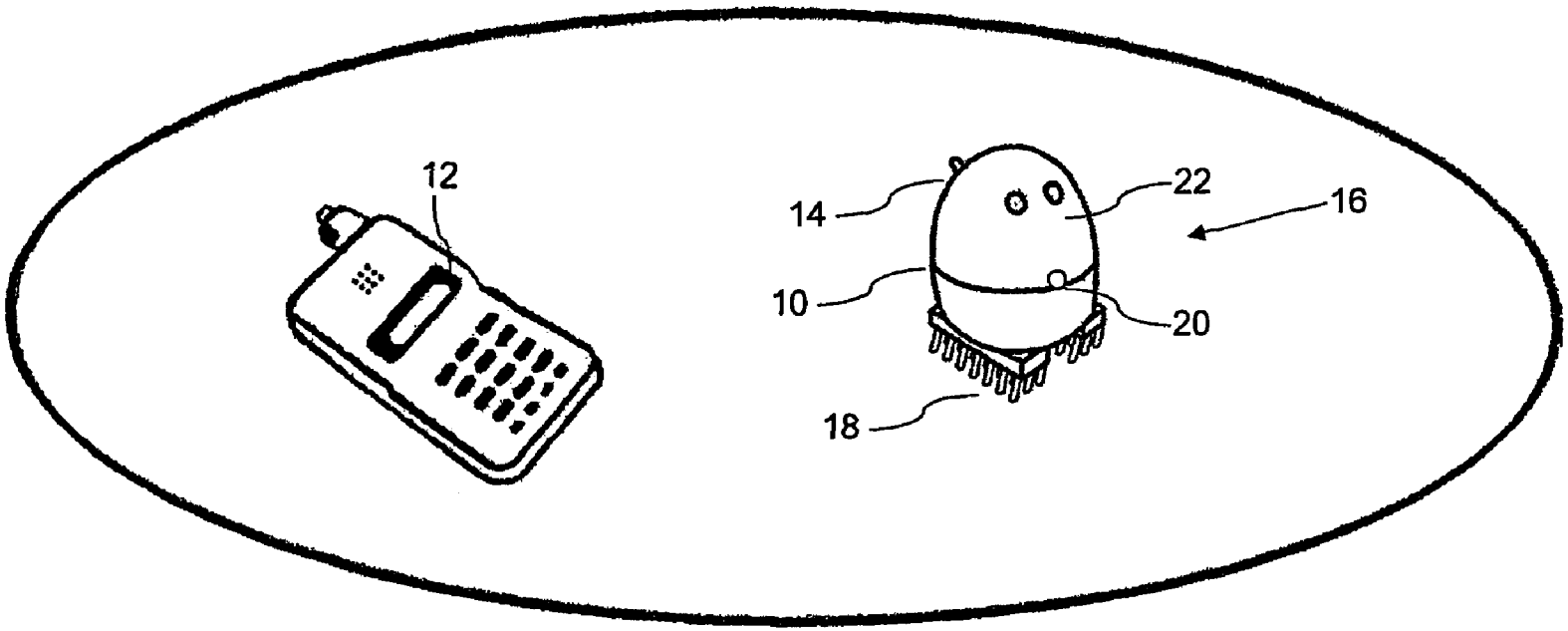

| | | | | |
|---|---|---|---|---|
| 4,310,987 | A * | 1/1982 | Chieffo | 446/458 |
| 5,088,949 | A * | 2/1992 | Atkinson et al. | 446/3 |
| 5,221,226 | A * | 6/1993 | Park | 446/353 |
| 5,601,433 | A * | 2/1997 | Potter | 434/130 |
| 5,626,505 | A * | 5/1997 | Cheng | 446/278 |
| 5,720,644 | A * | 2/1998 | Ku | 446/175 |
| 5,956,626 | A * | 9/1999 | Kaschke et al. | 455/115.1 |
| 5,957,745 | A * | 9/1999 | Johnson et al. | 446/234 |
| 5,993,286 | A * | 11/1999 | Tacquard et al. | 446/351 |
| 6,027,395 | A * | 2/2000 | Strom | 446/274 |
| 6,033,285 | A * | 3/2000 | Fine et al. | 446/465 |
| 6,129,606 | A * | 10/2000 | Yuen | 446/325 |
| 6,199,439 | B1 * | 3/2001 | Lin | 74/61 |
| 6,755,716 | B2 * | 6/2004 | Agostini et al. | 446/435 |
| 6,899,589 | B1 * | 5/2005 | Lund et al. | 446/351 |
| 6,964,572 | B2 * | 11/2005 | Cesa | 434/258 |
| 7,053,578 | B2 * | 5/2006 | Diehl et al. | 318/568.12 |
| 7,429,931 | B2 * | 9/2008 | Severson | 340/686.1 |
| 7,803,031 | B1 * | 9/2010 | Winckler et al. | 446/437 |
| 2002/0142701 | A1 * | 10/2002 | Rosenberg | 446/454 |
| 2006/0009117 | A1 * | 1/2006 | Severson | 446/410 |
| 2007/0107150 | A1 * | 5/2007 | Smith | 15/98 |
| 2008/0061644 | A1 * | 3/2008 | Treat | 310/81 |

FOREIGN PATENT DOCUMENTS

| | | | |
|---|---|---|---|
| GB | 2343536 | A | 5/2000 |
| GB | 2378617 | A | 2/2003 |
| GB | 2379138 | A | 2/2003 |
| GB | 2386796 | A | 9/2003 |
| GB | 2387504 | A | 10/2003 |
| JP | 2000059837 | A | 2/2000 |
| JP | 2000236371 | A | 8/2000 |
| WO | 2004/041391 | A | 5/2004 |
| WO | 2005/104520 | A1 | 11/2005 |

* cited by examiner

PORTABLE DEVICE

This invention relates to a portable device, which is propelled by a vibrating motor.

United Kingdom Patent Application Publication GB 2343536 discloses alerting apparatus. The apparatus, for example a mobile phone, has a first axis of rotation, engages a surface upon which the apparatus may be supported, and includes a motor. The motor has a rotor shaft with a second axis of rotation. The motor is activated to alert a user of the apparatus to an event such as an incoming telephone call or message. The motor is positioned within the apparatus such that the second axis of rotation is substantially parallel to the first axis of rotation, and activation of the motor produces a turning moment, causing the apparatus to rotate about the first axis. The device described in this document is very limited in its movement which, when responding to an incoming call, simply rotates on the spot.

Another similar system is disclosed in United Kingdom Patent Application Publication GB 2378617, which shows a mobile device that is designed to vibrate in response to a predetermined condition. The mobile device, which could be a mobile phone, has a vibrating device coupled to a processor and operable to vibrate in response to a predetermined condition such as an incoming call. The vibrations are transmitted to the external case which is profiled on the underside such that when the mobile device is placed on a surface such as a desk and the vibrating device is operated, the vibrations cause the mobile device to move on the surface, the movement being controlled by the processor such that the mobile device describes a predetermined locus on the surface. The mobile device may also be a hand-held game, toy or other portable electronic device. The vibrating device is a miniature multi-pole core-less micro-motor with an off axis mass with an axis of revolution perpendicular to the resting surface. The device in this document operates to move along a predetermined path, and will not move in an efficient or accurate manner, as the underside profile of a mobile phone case will not transfer the energy of the motor vibration into movement in a specific direction, in any controllable manner. Nor will it maximise the available thrust or turning moments.

It is therefore an object of the invention to improve upon the known art.

According to a first aspect of the present invention, there is provided a portable device comprising a motor for providing vibration, a power source for powering the motor, a switching device for controlling the direction of the motor, propelling means for engaging a surface and for propelling the device when the motor is vibrating, the propelling means extending downwardly at an angle to the vertical, and an input device connected to the switching device, the switching device arranged to switch the direction of the motor when the input device receives a predetermined signal.

Owing to this aspect of the invention, it is possible to provide a simple movable device that will change its style of movement when the motor changes direction. Moving parts are minimised in the device, and a variety of different inputs can be used to cause the direction of the motor to be switched. The design of the propelling means, which extend downwardly, and at an angle to the vertical ensures that the device moves in a controllable manner.

Advantageously, the propelling means comprises a set of bristles. By using angled bristles, this increases friction in the backwards direction and so causes the device to move forwards when vibrating. The bristles dig into surface when vibration tries to move the object backwards, and the bristles slide over surface when vibration tries to move object forwards.

The angled bristles are of a specifically chosen stiffness such that they flex and store the energy on the 'back stroke' and then straighten and release the energy on the forward stroke, helping to propel the object forward. If the bristles are too soft they will absorb the energy and it is wasted, if they are too stiff they will not flex and store the energy and instead the object is forced backwards on the backstroke. Such as would occur in the invention disclosed in GB2378617

Preferably, the axis of the motor is at an angle to the vertical and to the horizontal. The motor is set at an angle, so that the vibrating motion serves to increase friction in the backwards direction due to increased force into the surface, and to reduce friction in the forwards direction as the motion is away from the surface.

Ideally, the motor is rotating a weight, the centre of gravity of the weight offset from the axis of the motor, and the centre of gravity of the weight is spaced apart from the centre of gravity of the portable device. The angled motor is set away from and below the centre of gravity of the device to enhance the motion effect. This is because the centre of gravity of the device will tend to stay stationary, and all points rotate about it.

Mounting the moving offset weight away from the centre of gravity of the object induces a rotational rocking motion. This motion causes a turning motion when the unit is moving forward. By varying the distance of the weight from the centre of gravity of the unit, the turning circle of the unit can be altered. And by reversing the direction of rotation of the motor, the turning direction of the object can be altered.

Advantageously, the device further comprises a base, the base mounting the motor, the power source, and the switching device, wherein the propelling means extends downwardly from the base. The motor is mounted rigidly on the base and the power source and the switching device are mounted flexibly on the base. The vibration motor is connected directly to the base using a rigid support to maximize the transfer of vibrational energy and motion into the feet. Where possible other elements of the unit, especially those that are heavy, are mounted on flexible mountings. This is because, due to conservation of momentum, any mass connected to vibrating motor will reduce the amount of travel.

Preferably, the input device comprises a detector for detecting electromagnetic radiation, and the predetermined signal comprises a detected level of electromagnetic radiation. And/or the input device comprises a detector for detecting audio, and the predetermined signal comprises a specific sound. The portable device will react when a mobile phone is brought into proximity to the device, or can be configured to react to clicking of fingers or whistling, or any other suitable sound. In a further embodiment, the control means is a light source and the detected direction of the light source is used to determine the direction of rotation of the motor.

Figure 2:
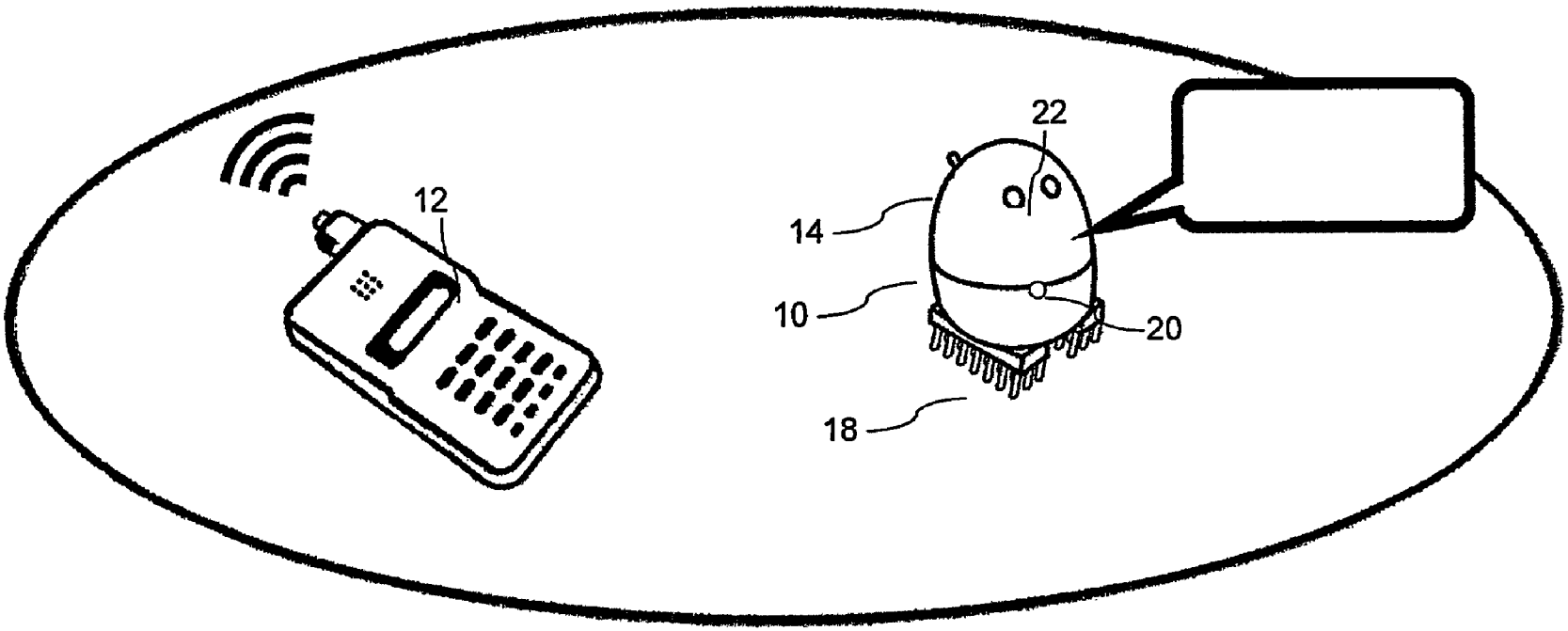
Figure 3:
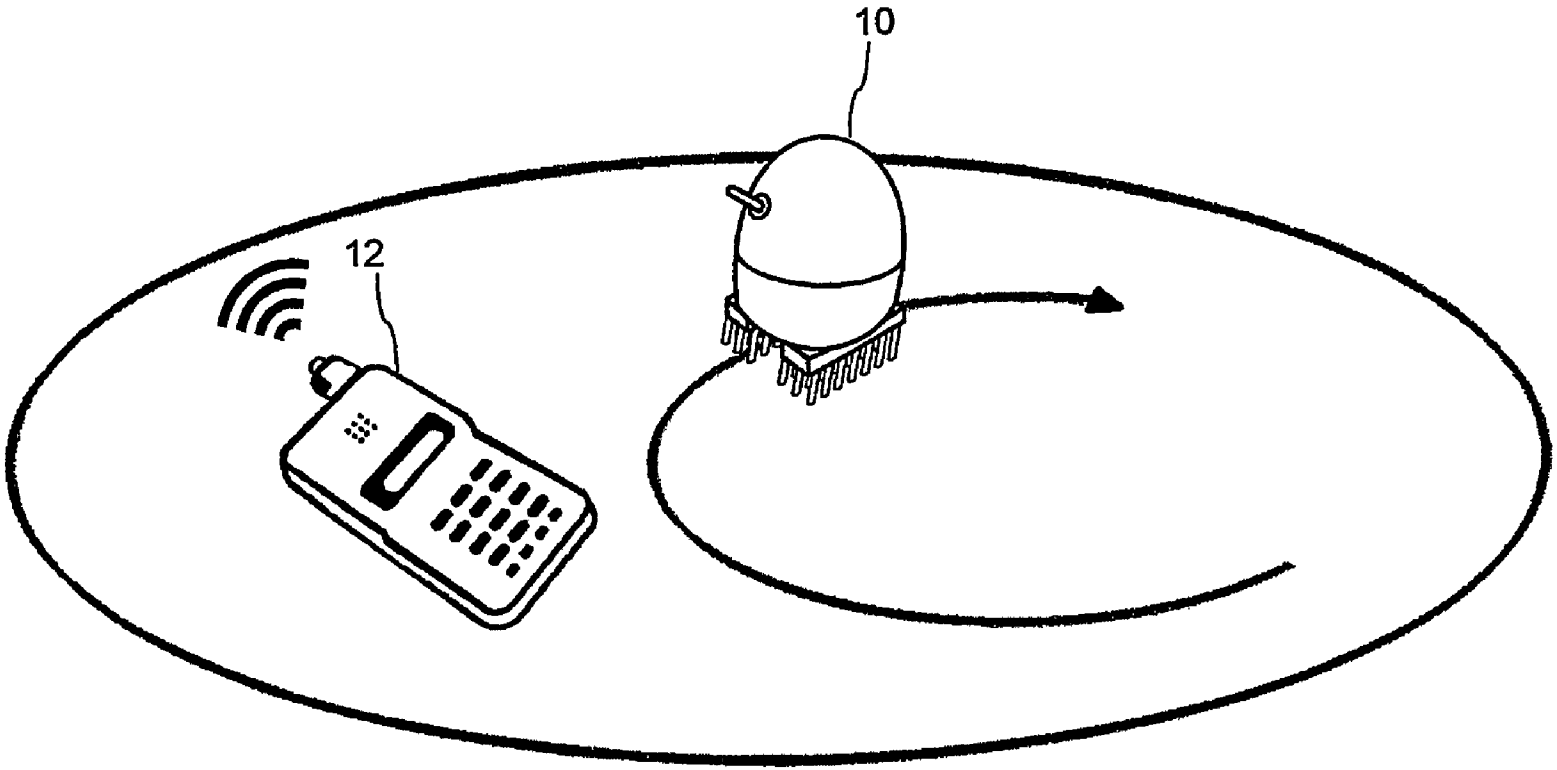
Figure 4:
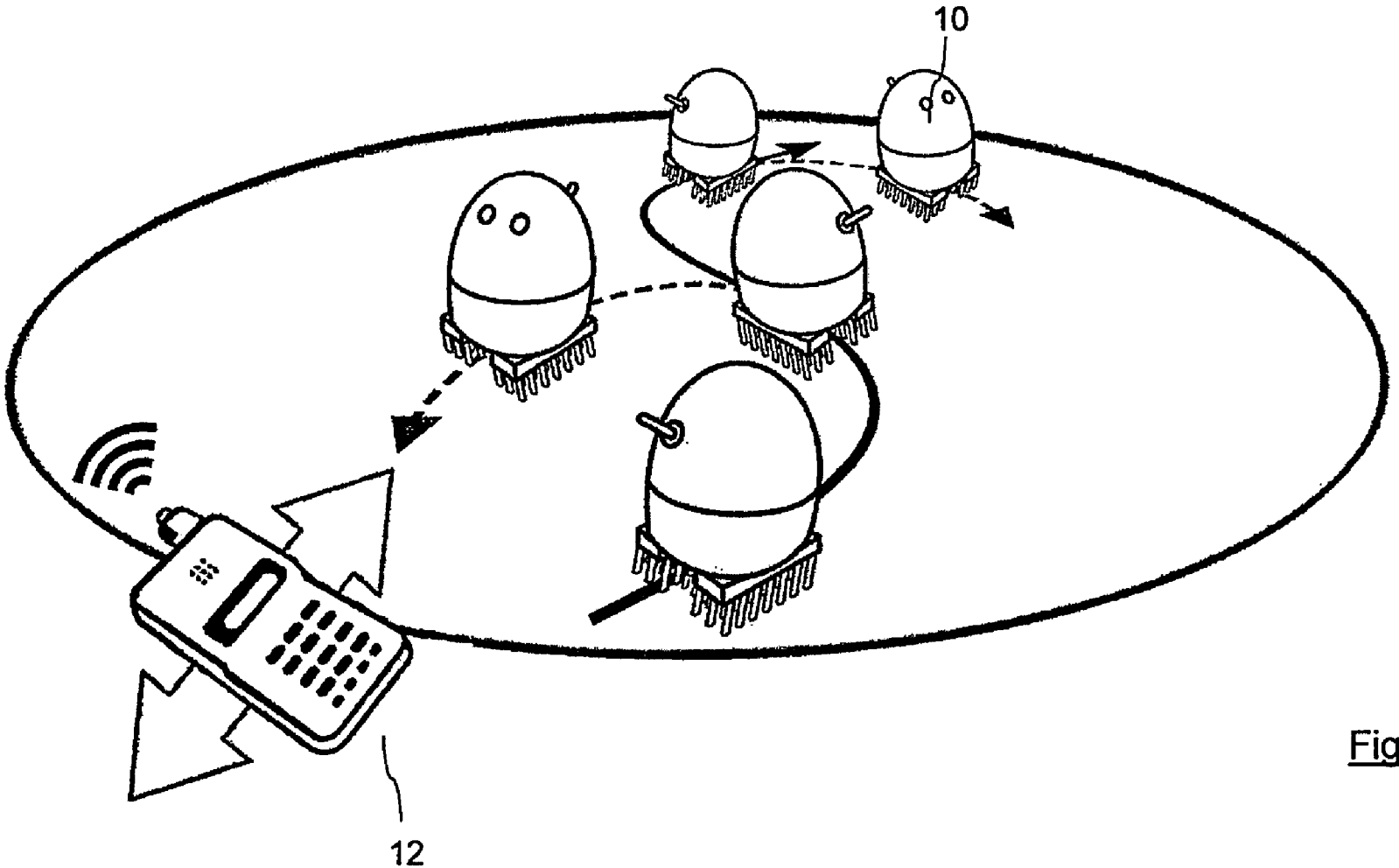
Figure 5:
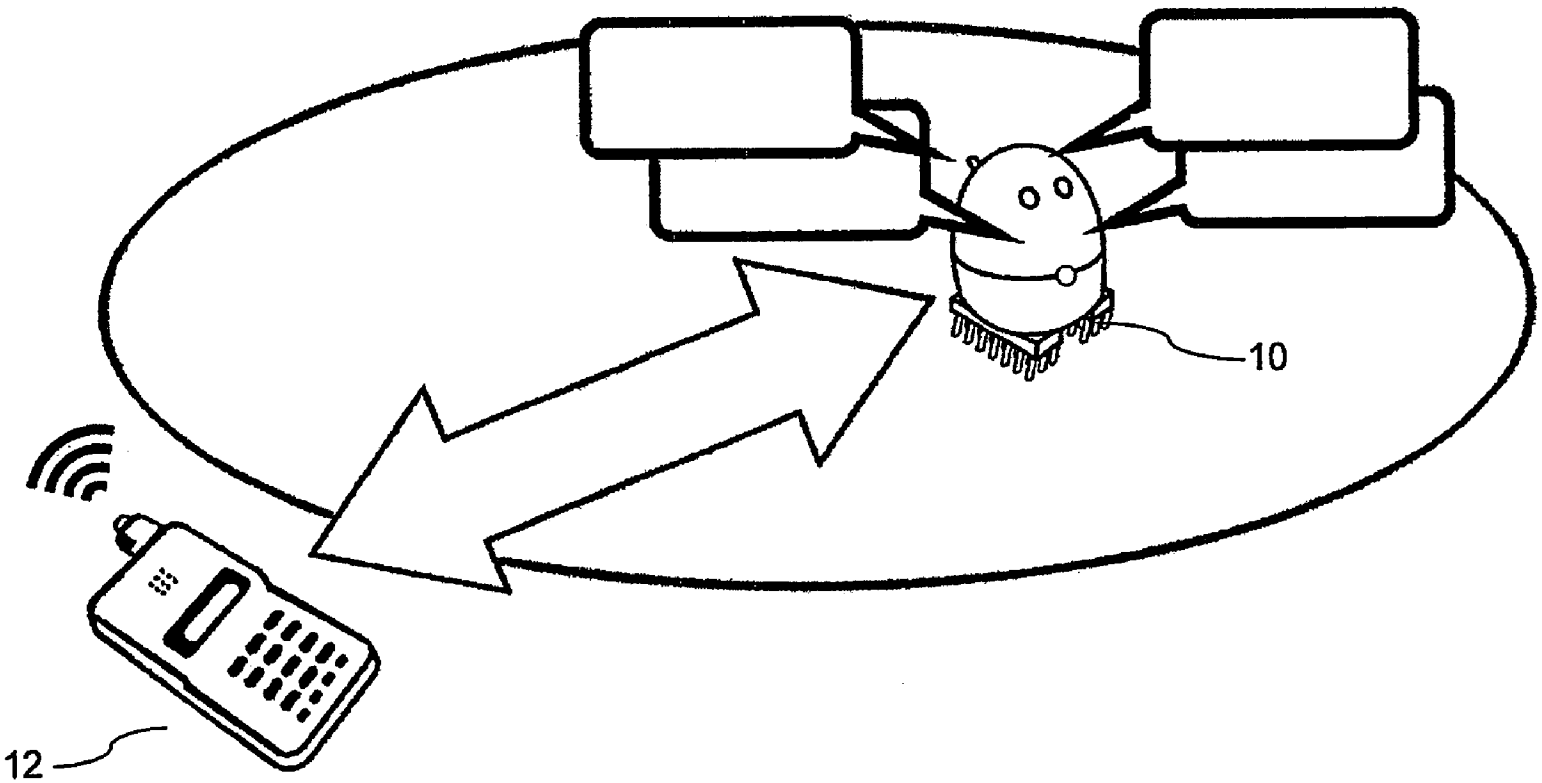
Figure 6:
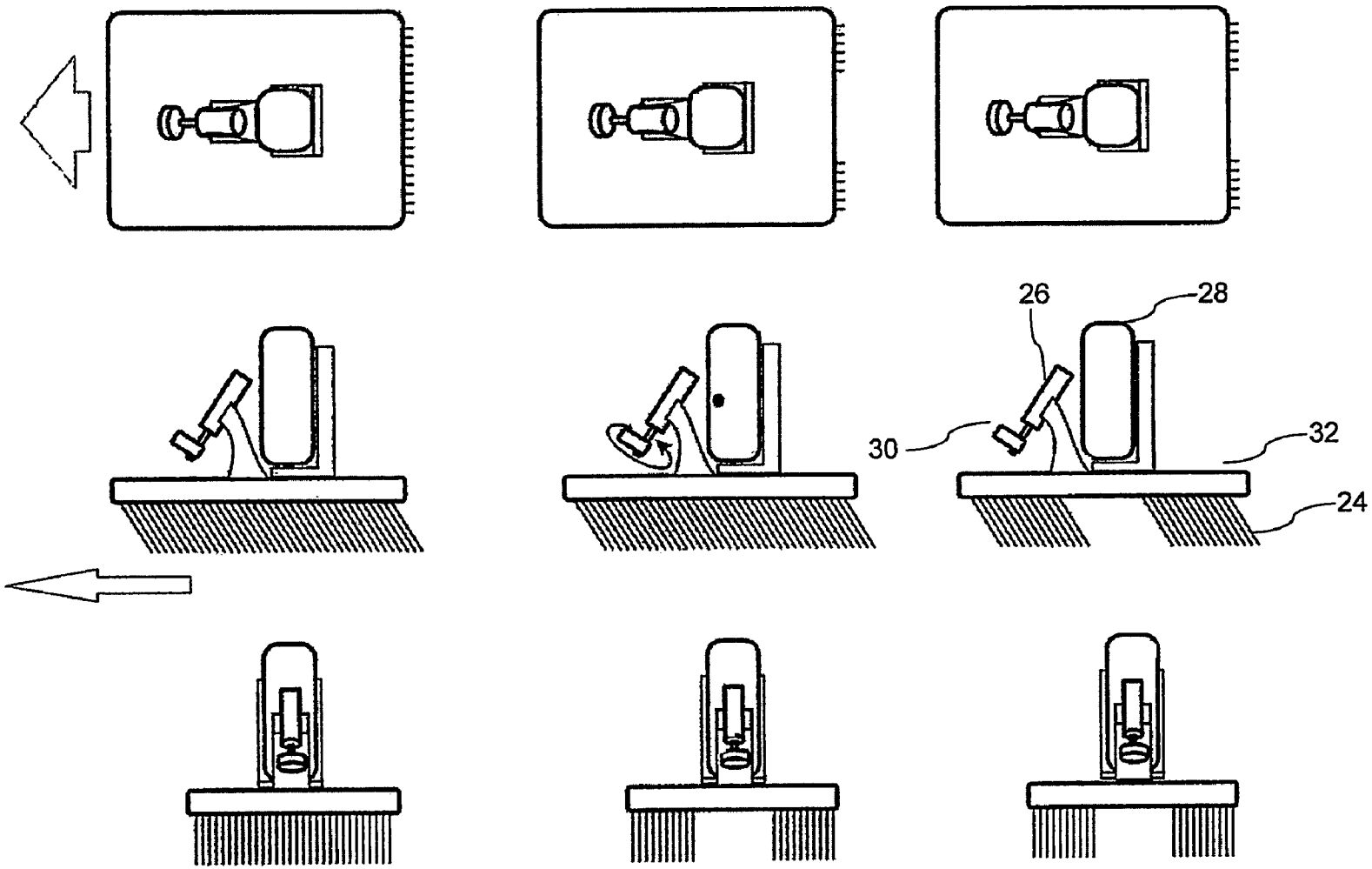
Figure 7:
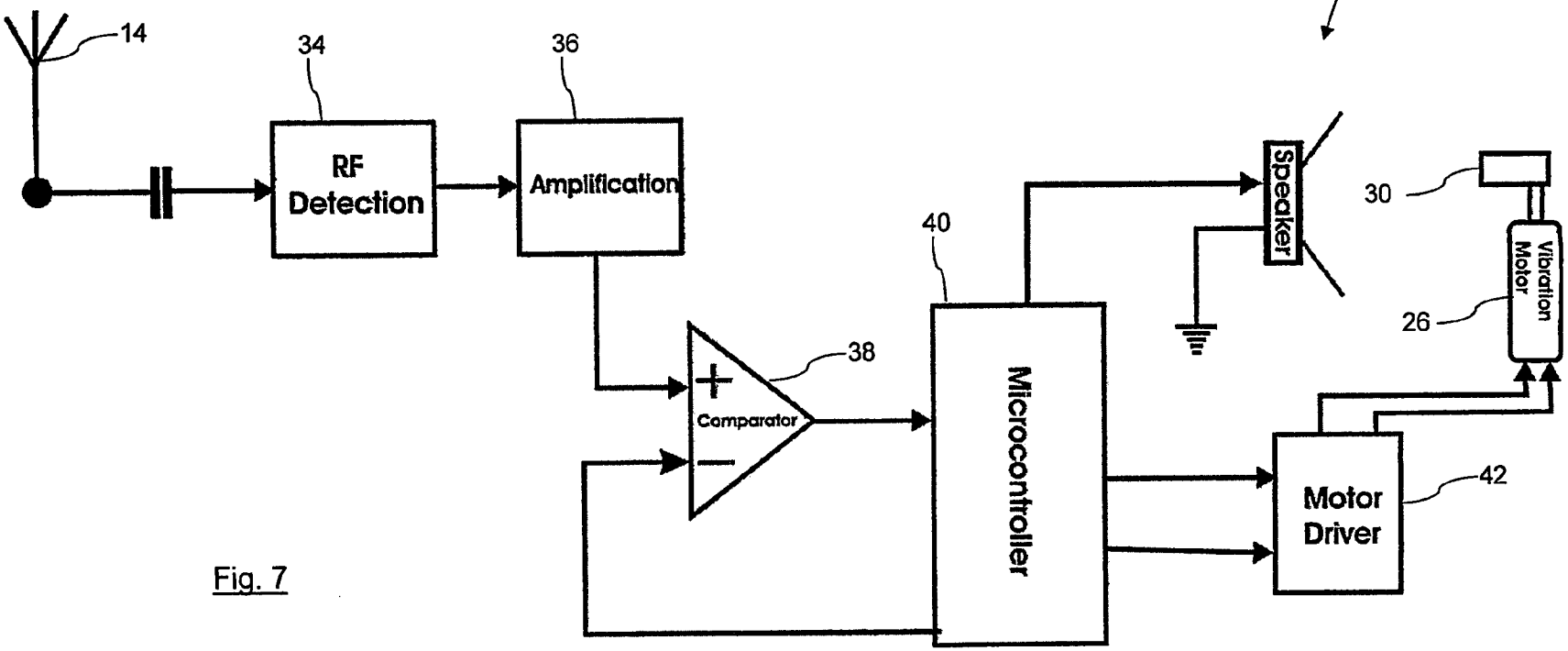
Figure 8:
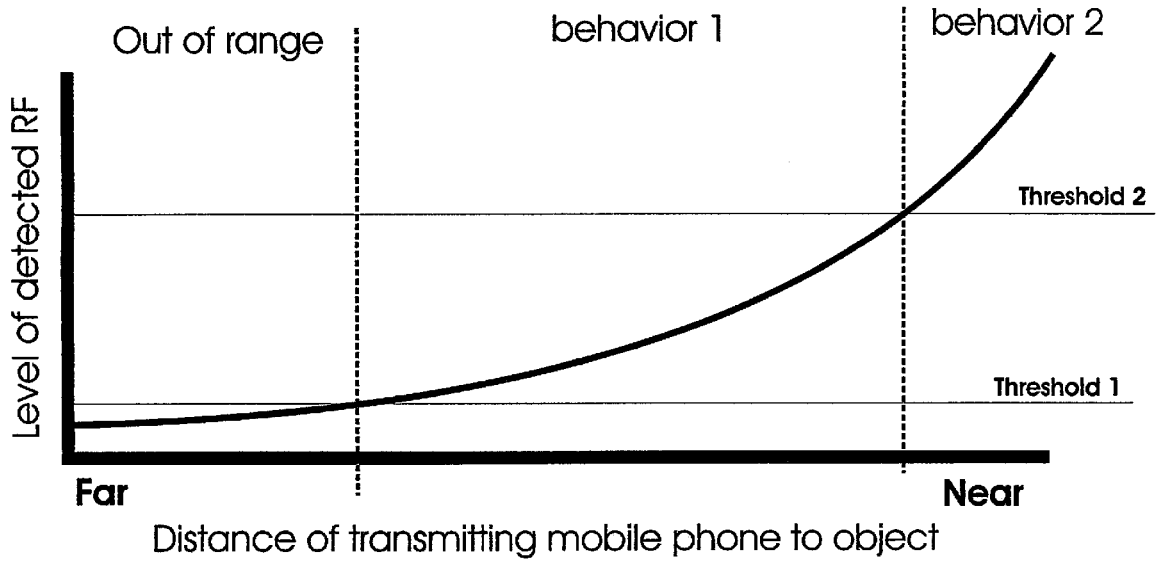
Figure 9:
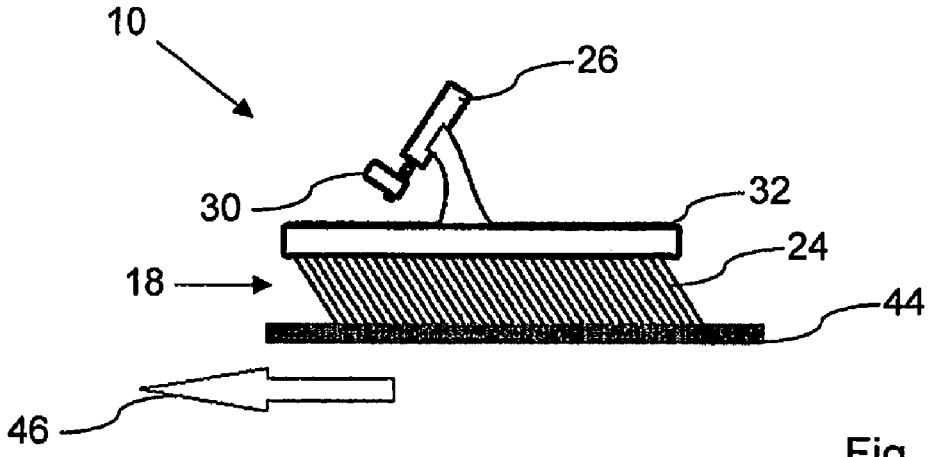
Figure 10:
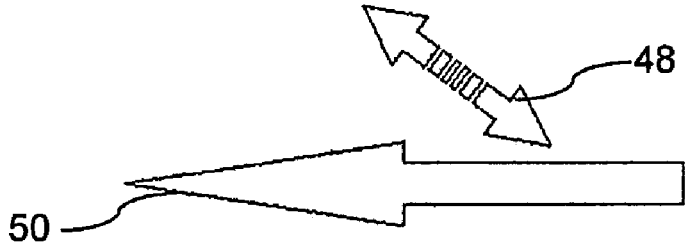
Figure 11:
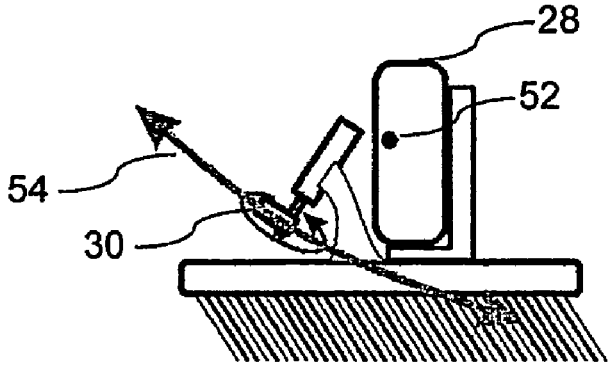
Figure 12:
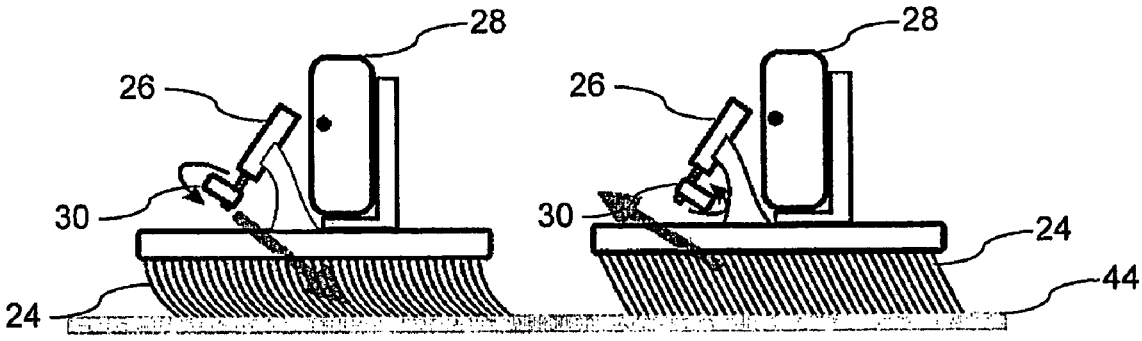
Figure 13:
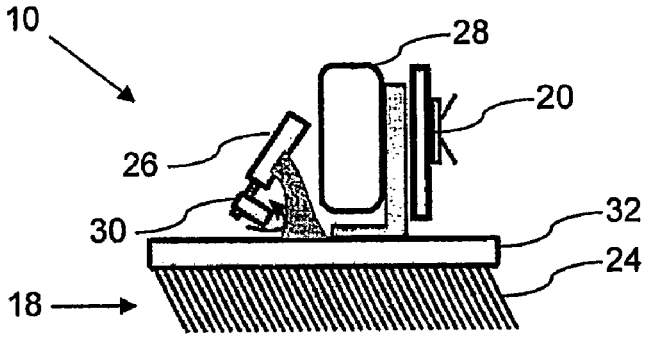
Figure 14:
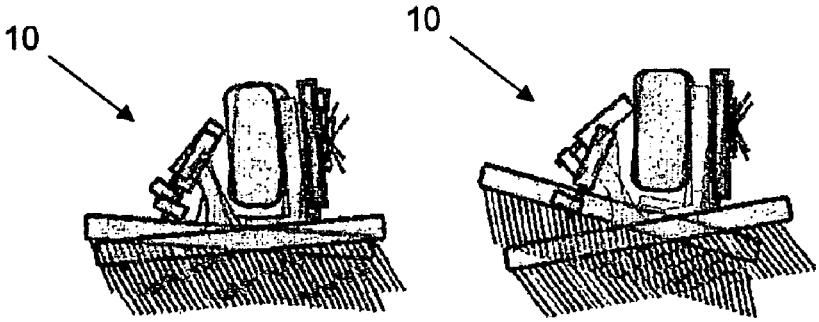

Embodiments of the present invention will now be described, by way of example only, with reference to the accompanying drawings, in which:

FIG. 1 is a perspective view of a portable device and a mobile phone,

FIG. 2 is a view, similar to FIG. 1, of the portable device and the mobile phone, with the mobile phone receiving a call, FIG. 3 is a view, similar to FIG. 2, of the portable device and the mobile phone, with the portable device responding in a different manner, FIG. 4 is a view, similar to FIG. 1, showing the effect on the portable device of the proximity of the mobile phone, FIG. 5 is a view, similar to FIG. 4, showing a different effect on the portable device of the proximity of the mobile phone, FIG. 6 is a set of three top, side and front views of three embodiments of the portable device, FIG. 7 is a circuit diagram of the internal components of the portable device, FIG. 8 is a graph showing distance of mobile phone from device against level of detected RF, illustrating behaviour thresholds, FIG. 9 is a further side view of the portable device, FIG. 10 is a schematic diagram of arrows indicating direction of rotation of a motor versus direction of travel, FIG. 11 is a side view, similar to FIG. 9, of the portable device, FIG. 12 is a side view of a pair of the portable devices illustrating the motion of bristles on the device, FIG. 13 is a side view of a further embodiment of the portable device, and FIG. 14 is a side view of a pair of the portable devices.

FIG. 1 shows a portable device 10 and a mobile phone 12. The portable device 10 includes an input device 14, in the form of a detector 14, for detecting electromagnetic radiation. The detector 14 is a standard aerial for receiving radio frequency (RF) communications as used in, for example, the mobile telephony domain. The portable device 10 is also provided with output means 16, which in the device 10 of FIG. 1 has three components; propelling means 18 for moving the portable device 10, audio means 20 and display means 22.

When the phone 12 rings (as shown in FIG. 2) the device 10 wakes up from the sleep mode and makes a sound (beep beep) from the audio means 20. Then, as long as the device 10 is still detecting RF, (i.e. the phone is still emitting RF and within range), the device 10 continues to emit sounds from the audio means 20.

Because the device 10 can also detect the level of received RF, it can tell approximately how close the phone 12 is to the detector 14. Therefore, by moving the phone 12 closer to the device 10, as shown in FIG. 3, the portable device 10 goes into play mode. As shown in FIG. 4, the device 10 can be steered by varying the proximity of the phone 12, according to a simple scheme, phone near—device 10 turns left, phone further away—device 10 turns right, move phone far away—device 10 stops. After a defined period of not receiving RF then the device 10 goes back into standby mode, and awaits detection of RF.

Internally within the device 10 is a control device connected to the detector 14 and the output means 16. The control device (shown in more detail in FIG. 7) is for controlling the output means 16 dependent upon the output of the detector 14. The output means 16 operates in a first manner when the detected electromagnetic radiation is above a first threshold and output means operates in a second manner when the detected electromagnetic radiation is above a second threshold, the first and second manner being different from one another. The second threshold is higher than the first threshold.

The device 10 can continue responding while a user is still on the phone, but the device 10 will go into play mode when the phone 12 is held close. The portable device 10 can then be steered (or some other behaviour change occurs) by varying the proximity of the phone 12. The generation of RF from the phone 12 does not have to be triggered by the making or receiving of a call, if a user dials 1111 or any other non existent number, a standard mobile phone will stream RF whilst it tries to connect and there is no cost to a user for this service.

The portable device 10 supports the controlling/steering and changing of device's behaviour (sound/movement/lights etc) according to the proximity of the mobile phone 12. FIG. 5 shows an alternative version of the device 10, whereby the proximity of the mobile phone 12 causes a change in the operation of the audio means of the device 10. As the mobile phone 12 is brought into proximity with the device 10, then the device enters the play mode and the audio that is emitted by the device 10 changes character from that used when the device 10 has detected a low level of RF. When the detected level of RF exceeds the set threshold (indicating that the phone 12 is in close proximity to the device 10) then a different audio output is used.

FIG. 6 shows the components of the portable device 10 in more detail. Three different arrangements are shown in this Figure, but the arrangements only differ in the layout of the bristles 24 used as propelling means 18 for propelling the device 10 forward. The portable device 10 also includes a motor 26 for providing vibration, a unit 28 containing a power source for powering the motor, and a switching device for controlling the speed and direction of the motor. The propelling means 18 is for propelling the device when the motor 26 is vibrating.

In order to drive and steer the device 10, the motor 26 is provided with an offset weight 30, the centre of gravity of the weight 30 being offset from the axis of the motor 26. The unit 28 also includes an input device connected to the switching device, the switching device arranged to switch the direction of the motor 26 when the input device receives a predetermined signal. By using vibration to drive the device 10 forward, and by changing the direction of the rotation of the motor 26, owing to the construction of the device 10, this causes the device 10 to arc left or right, enabling the device 10 to be steered.

The mounting of the motor 26 directly on to a base 32 helps transfer the vibration to the bristles 24 and provides more forward thrust. The angled bristles 24 serve 2 functions, they increase friction in the backwards direction and so cause the device 10 to move forwards when the motor is vibrating, and they store some of the energy when the device 10 tries to move backwards, and release the energy, as the device 10 moves forward. This helps translate more of the circular vibration into forward movement. Other arrangements (for example, springs as mini pogo sticks, or small shock absorbers) can also be used to perform the forward movement.

By angling the motor 26 in such a way that the vibration occurs in a plane orientated to the forward direction as shown the friction is increased in the backwards direction due to increased force into the surface. More energy is stored in the bristles 24 as the backwards motion is in a direction to compress the bristles 24. The friction is reduced in the forward direction as the motion is away from the surface.

Mounting the moving offset weight 30 away from the centre of gravity of the device 10 induces a slight rotational rocking motion. This motion causes a turning motion when the device 10 is moving forward. And so allowing the object to be steered by altering the direction in which the motor is turning. By varying the distance of the weight 30 from the centre of gravity of the device 10, the turning circle of the device 10 can be altered. The motion of the device 10 when the motor 26 is near the centre of gravity is a slight turn off the straight line, whereas the motion when motor 26 is away from centre of gravity is a relatively sharp turn in either direction.

Allowing the motor, base and bristles to vibrate independently of the main weight of the device 10 (batteries etc) allows more movement in bristles/base and so provides faster forward travel. The contact area between the unit and the surface can be any shape. The angling of the vibration motor 26 to the vertical maximizes forward thrust from the propelling means. The use of angled bristles generates forward motion from the vibration motor 26. The steering of the device 10 by the proximity off a mobile phone can also be used to make wheeled vehicles steered by the proximity of a device such as a mobile phone.

The method of driving/steering discussed above does not have to be controlled using a source of RF such as a phone. For example, an audio trigger such the click of fingers could be used to change the motor direction (and hence the direction of travel of the device 10). It is also possible to provide a device 10 that responds to frequency so that a user can whistle or play music to the device 10 to control the movement of the device 10.

The device 10 supports the changing the direction of the motor due to the proximity of a transmitting mobile phone, and the starting and stopping the motor due to the proximity of a mobile phone. Likewise, the changing of the device's behaviour due to the proximity of a phone such as altering speech/audio output can be triggered by the proximity of the phone.

FIG. 7 shows in more detail the electronics used in the portable device 10. The antenna 14 (acting as a detector), is connected via an RF detection circuit 34, amplifier 36 and comparator 38 to a control device 40. The control device 40 communicates with the output means 16 (shown here as audio means) and a motor driver 42. The motor driver powers the motor 26, which has the weight 30 offset from the rotation axis of the motor 30.

RF in the frequency range 900 MHz-2000 MHz (the frequency used by mobile phones) is detected by the RF detection circuit 34 and amplified, such that, when a mobile phone is in use in the vicinity of the device 10 (usable range can be adjusted by varying the amplification) a pulse stream is present at the input of the comparator 38. The amplitude of this signal is proportional to the strength of the RF present at the antenna 14. A reference voltage is applied to the other input of the comparator 38. The output of the comparator 38 is then checked by the microcontroller 40 to determine if the value of the RF present is higher or lower than the reference voltage (the threshold). By varying the comparator reference voltage the microcontroller determines if the mobile phone 12 is in use and if so, near or far away. Alternatively, an analogue to digital converter could be used.

Based on the determined proximity of the mobile phone 12, the microcontroller 40 outputs sounds and alters the state and/or direction of rotation of the motor 26. The microcontroller 40 also checks the timing of the incoming pulses to determine if the RF is from a mobile phone and not another RF source such as WIFI, microwave or a Bluetooth device.

FIG. 8 illustrates how the level of detected RF will change as the mobile phone 12 is moved towards the device 10. Thresholds 1 and 2 have been illustrated on the graph. The choice of the position of the thresholds is a design choice, and will depend upon the hardware and circuitry used in the device 10.

Multiple thresholds and multiple corresponding behaviours can be used, including a proportional change in the behaviour of the device 10 as the mobile phone 12 is moved towards the device 10. For example, the volume of the output from the audio means of the device 10 could increase as the phone 10 is moved towards the device 10. Or the speed of the motor altered. In this case, the device 10 can be considered to be operating a very large number of incremental thresholds, each determining a change in the behaviour of the device 10.

The device 10 supports the changing of the vibration motor 26 direction based on the distance of in-use mobile phone, or on the strength of a detected external RF signal. Likewise, changing arc direction of the device 10 based on proximity to an in-use mobile phone, or on the strength of a detected RF signal, and steering the device 10 can be achieved. The audio output of the device 10 can also be configured so that the volume of sound output is altered, based on the proximity of an in-use mobile phone or by on the strength of a detected RF signal.

FIG. 9 shows the portable device 10 with the propelling means 18 (bristles 24) engaging a surface 44. The bristles 24 are for propelling the device 10 forward in the direction of the arrow 46 when the motor is vibrating. The propelling means 18 are extending downwardly at an angle to the vertical. FIG. 10 shows the relationship between the rotation of the motor 26 (arrow 48) and the forward movement of the device 10 (arrow 50).

In FIG. 11, the centre of gravity 52 of the device 10 is shown. The centre of gravity of the weight 30 is spaced apart from the centre of gravity 52 of the portable device 10. The arrow 54 shows how the weight 30 effectively vibrates around the centre of gravity 52 of the portable device 10. The unit 28 which contains batteries for the device 10 and the electronic components is relatively heavy, and most of the weight of the device 10 is concentrated at the unit 28. FIG. 12 illustrates how the rotation of the weight 30 supplies the forward movement of the device 10. In the left hand view of FIG. 12, the weight 30 is at its highest point having rotated away from the surface 44 (the weight 30 being offset from the axis of rotation of the motor 26). This causes the bristles 24 to flex and store energy. As the weight 30 continues its rotation (right hand view of FIG. 12), the bristles 24 unflex and propel the device 10 forwards. As this cycle is repeated, the device 10 glides forward under the power of the vibrating motor 26.

FIG. 13 shows a further embodiment of the portable device 10, with the audio means 20 mounted on the back of a PCB 56. The device includes the base 32, the base 32 mounting the motor 26, the power source and the switching device inside the unit 28, with the propelling means 18 extending downwardly from the base 32. The motor 26 is mounted rigidly on the base 32 and the power source and the switching device are mounted flexibly on the base 32. FIG. 14 shows the difference in movement of the device 10, when comparing a rigid mounting of the components (left hand view) to a flexible mounting of the components (right hand view). Where possible in the device 10, the elements (excepting the motor) are mounted flexibly. This is because, owing to the conservation of momentum, any mass connected to the vibrating motor reduces the amount of vibration and therefore of travel of the device 10. It is therefore advantageous to mount the components such as the battery flexibly on the base 32.

The device 10 can be modified to use two motor and two corresponding weights. This will allow a variety of motion, such as left, right and forward as the motors are used in different combinations. When a user brings their phone into proximity with the device 10, the different levels of radiation detected can be used to control both motors in combination. The thresholds at which the behaviour of the portable device 10 changes can be user adjusted, perhaps by one or more knobs provided on the portable device 10. This allows the user to set the distance(s) at which the behaviour of the device 10 changes.

The device 10, in the embodiments above, is controlled by the detection of RF signals. However, the input device that controls the switching of the motor direction can comprise a detector for detecting audio, in which case the device 10 will respond to specific sounds such as whistles, voice commands or a user clapping or clicking their fingers. In a similar fashion, the device 10 could include a detector for detecting visible light, and the signal to which the device 10 responds comprises a specific light level, so that the device 10 will change its movement based upon a light being shined on the device 10.

The invention claimed is:

1. A portable device comprising a motor for providing vibration, a power source for powering the motor, the motor rotating a weight, a center of gravity of the weight offset from an axis of the motor and spaced apart from a center of gravity of the portable device, a switching device for controlling a rotational direction of the motor, propelling means for engaging a surface and for propelling the device when the motor is vibrating, the axis of the motor lying in a direction of the movement of the portable device, the offset of the weight configured to induce a rotational rocking motion of the portable device when the motor is activated, the propelling means extending downwardly at an angle to vertical, and an input device connected to the switching device, the switching device arranged to switch the direction of the motor when the input device receives a predetermined signal, wherein changing the rotational direction of the motor causes the portable device to move in one of a left or right arc.

2. A device according to claim 1, wherein the axis of the motor is at an angle to vertical and to horizontal.

3. A device according to claim 1, and further comprising a base, the base mounting the motor, the power source, and the switching device, wherein the propelling means extends downwardly from the base.

4. A device according to claim 3, wherein the motor is mounted rigidly on the base and the power source and the switching device are mounted flexibly on the base.

5. A device according to claim 1, wherein the propelling means comprises a set of bristles.

6. A device according to claim 1, wherein the change in direction of the motor results in a change in direction of the motion of the portable device.

7. A device according to claim 1, wherein the input device comprises a detector for detecting electromagnetic radiation, and the predetermined signal comprises a detected level of electromagnetic radiation.

8. A device according to claim 1, wherein the input device comprises a detector for detecting audio, and the predetermined signal comprises a specific sound.

9. A device according to claim 1, wherein the input device comprises a detector for detecting visible light, and the predetermined signal comprises a specific light level.

* * * * *